US005974290A

United States Patent [19]

Inoue

[11] Patent Number: 5,974,290

[45] Date of Patent: Oct. 26, 1999

[54] IMAGE FORMING APPARATUS HAVING SHEET GUIDE MEMBERS OPENABLE FOR REMOVING A JAMMED SHEET

[75] Inventor: Nobuo Inoue, Kamagaya, Japan

[73] Assignee: Ricoh Company, Ltd., Tokyo, Japan

[21] Appl. No.: 09/256,473

[22] Filed: Feb. 23, 1999

[30] Foreign Application Priority Data

Feb. 24, 1998 [JP] Japan ..... 10-041733
Jul. 14, 1998 [JP] Japan ..... 10-199180

[51] Int. Cl.[6] ..... G03G 15/00; G03G 15/20; B65H 39/10

[52] U.S. Cl. ..... 399/124; 271/301; 399/21

[58] Field of Search ..... 271/3.19, 4.01, 271/4.03, 126, 291, 301, 302; 399/16, 21, 107, 124

[56] References Cited

U.S. PATENT DOCUMENTS 5,191,383 3/1993 Watanabe ..... 399/124
5,291,256 3/1994 Kitajima et al. ..... 399/122

FOREIGN PATENT DOCUMENTS 10-316294 2/1998 Japan .
10-147451 6/1998 Japan .

*Primary Examiner*—Arthur T. Grimley
*Assistant Examiner*—Hoang Ngo
*Attorney, Agent, or Firm*—Oblon, Spivak McClelland, Maier & Neustadt, P.C.

[57] ABSTRACT

An image forming apparatus includes a reversing unit which reverses and feeds recording material fed from a fixing device, and a guiding device including first and second guide members facing each other to form a part of a first conveying path in which a recording material with a toner image fixed thereto is conveyed to the reversing unit from the fixing device. The second guide member forms, in cooperation with a third guide member, a part of a second conveying path in which the recording material is conveyed to an outside of the main body of the image forming apparatus. The first and second guide members are movable between a sheet guide position in which the first and second guide members guide the recording material along the first and second conveying paths, and a sheet jam removing position in which each of the first and second conveying paths is opened for removal of a jammed sheet. A feeding device feeds the recording material fed from the fixing device through the first and second conveying paths, respectively, and a displacement device displaces the first and second guide members to the sheet guide position or the sheet jam removing position in cooperation with the reversing unit.

16 Claims, 11 Drawing Sheets

IMAGE FORMING APPARATUS HAVING SHEET GUIDE MEMBERS OPENABLE FOR REMOVING A JAMMED SHEET

BACKGROUND OF THE INVENTION

1. Field of the Invention

The present invention relates to an image forming apparatus, such as a photocopier, a printer, a facsimile machine, and the like, and in particular, to an image forming apparatus having a plurality of parallel mounted sheet conveying paths formed by a plurality of movable sheet guide members.

2. Discussion of the Background

In an image forming apparatus such as a photocopier, a printer, a facsimile machine, and the like, the apparatus is increasingly requested to be provided with multiple functions, reduced in size, and operated at high speeds. In order to satisfy these requests, constructions of conveying paths for conveying recording materials with an image fixed thereto become particularly complicated. To achieve high speed operation, a feeding interval of recording materials (sheet interval) is reduced, or a feeding speed (linear velocity) is increased. The image forming apparatus is also variously devised in consideration of an occurrence of sheet jamming so that a user can easily remove a jammed recording material or sheet in each conveying path of the apparatus. However, depending on an installation place or configuration of the apparatus, jam removing may not be able to be performed from the outside of the apparatus.

Generally, a pair of feeding rollers, a drive roller, and a driven roller for feeding the recording materials are arranged facing a conveying path such that the drive roller and the driven roller abut on or press against each other. In an image forming apparatus in which stacked documents are taken in, in one mode the documents are stacked with surfaces to be read facing downward, and are taken in from a lowermost or uppermost document. In another mode, the documents are stacked with surfaces to be read facing upward, and are taken in from the lowermost or uppermost document. In these modes, when the uppermost stacked document with its surface to be read facing upward or the lowermost stacked document with its surface to be read facing downward is first taken in or when duplicate photocopying is performed, a reversing unit is provided. In order to achieve high speed operation of an image forming apparatus provided with a reversing unit, the interval between the recording materials (sheet interval) is reduced by the constructions in which a conveying path connecting a fixing device and the reversing unit and a conveying path connecting the reversing unit and a sheet discharging section are arranged in parallel, and a feeding path and a discharging path of the recording materials relative to the reversing unit are independently provided.

In an image forming apparatus provided with a reversing unit, the reversing unit is movably mounted on a main body of the image forming apparatus for removing a jammed sheet, but the conveying paths are not released with the movement of the reversing unit. Therefore, when the reversing unit is pulled out with the sheet jammed therein, the sheet after fixing is torn and left in the conveying paths or the reversing unit. Accordingly, a user has difficulties in removing the jammed sheet completely.

To solve the above-mentioned problem, the present applicant proposed an image forming apparatus in which conveying paths are arranged in parallel and are opened/shut inside the apparatus because a part of the conveying paths are formed by guide members disposed movably between a sheet guide position in which recording materials are guided along the conveying paths and a sheet jam removing position in which the conveying paths are opened for removal of a jammed sheet. Further, in the image forming apparatus, it is constructed that the guide members are movable by a pressing protrusion provided on the inner surface of an exterior cover, so that a plurality of conveying paths arranged in parallel are opened when the exterior cover is opened.

The pressing protrusion fixed to the inner surface of the exterior cover is formed to be long and large enough to have sufficient size and strength to be inserted inside the main body of the image forming apparatus. Therefore, when the exterior cover is opened, the pressing protrusion gets in the way of jam removing operations. Moreover, when the guide members are in the sheet jam removing position, each conveying path is opened. In this case, however, when drive and driven rollers are not separated from each other, the jammed recording material is held between the rollers, and cannot be securely removed.

SUMMARY OF THE INVENTION

It is therefore an object of the present invention to provide a novel image forming apparatus in which jammed recording materials can securely be removed from a plurality of parallel mounted conveying paths with a simple operation, while high speed operation of the image forming apparatus can be achieved.

According to an aspect of the present invention, the above and other objects are achieved by a novel image forming apparatus having a fixing device which fixes a toner image on a recording material. A reversing unit is movably provided in a main body of the image forming apparatus to reverse and feed the recording material fed from the fixing device carrying a toner image fixed thereto. A guiding device guides the recording material fed from the fixing device toward an outside of the main body of the image forming apparatus, the guiding device including first and second guide members facing each other to form a part of a first conveying path in which the recording material with a toner image fixed thereto is conveyed to the reversing unit from the fixing device. The second guide member forms, in cooperation with a third guide member which is fixed in the main body of the image forming apparatus, a part of a second conveying path in which the recording material fed from the reversing unit is conveyed to an outside of the main body of the image forming apparatus. The first and second conveying paths are arranged in parallel in the main body of the image forming apparatus. The first and second guide members can be inclined relative to a vertical direction, and are movable between a sheet guide position in which the first and second guide members guide the recording material along the first and second conveying paths and a sheet jam removing position in which each of the first and second conveying paths is opened for removal of a jammed sheet.

A feeding device feeds the recording material fed from the fixing device through the first and second conveying paths, respectively. The feeding device includes a drive roller arranged facing both of the first and second conveying paths, a first driven roller arranged facing the first conveying path to contact the drive roller across the first conveying path, and a second driven roller arranged facing the second conveying path to contact the drive roller across the second conveying path. A displacement device is provided to displace the first and second guide members to the sheet guide position or the sheet jam removing position in cooperation with the reversing unit and to make the drive roller and driven rollers contact or separate from each other in cooperation with the displacement of the first and second guide members.

The second conveying path can include conveying direction switching sections respectively curved in a curled direction and a reverse curled direction of the recording material fed from the fixing device upstream and downstream of the drive roller in a conveying direction of the recording material, respectively, and at least one guide protrusion for reducing a gap of the second conveying path at a portion of the second guide member located upstream of a nipping portion, formed by the drive roller and the driven roller, in the conveying direction of the recording material.

The image forming apparatus can further include a support member to support the driven roller swingably provided to engage with the second guide member to displace the driven roller in a direction to press the drive roller when the second guide member is in the sheet guide position and to disengage from the second guide member to be displaced by gravity in a direction in which the driven roller is separated from the drive roller when the second guide member is in the sheet jam removing position. The driven roller may be mounted to the support member via an elastic member.

The support member can be configured such that an end of the support member positioned on an opposite side of a swing center of the support member relative to the other end of the support member engaging with the second guide member presses the third guide member disposed opposing the end when the second guide member is in the sheet guide position.

The image forming apparatus can further include a swingable member mounted on a rotation shaft, a pressing member fixed on the rotation shaft to abut on and press against the first guide member, and a pressing device provided on the reversing unit to press the swingable member. The pressing device presses the swingable member to hold the first and second guide members in the sheet guide position and releases the pressed swingable member to hold the first and second guide members in the sheet jam removing position.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
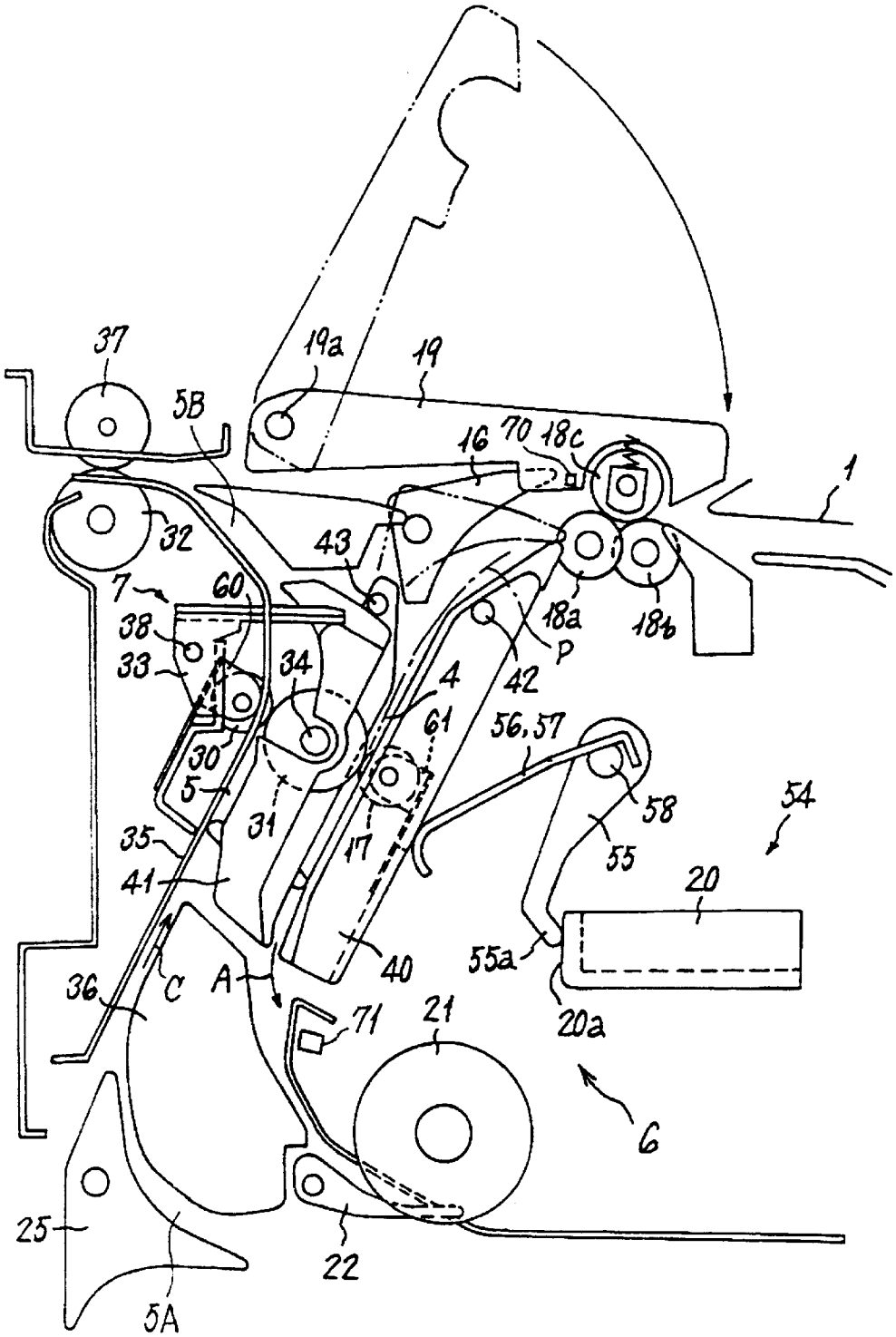
FIG. 1 is an enlarged view showing structures of conveying paths and a displacement device in an image forming apparatus of the present invention.

An embodiment of the present invention applied to an image forming apparatus is described hereinafter by referring to the accompanying drawings, wherein like reference numerals designate identical or corresponding parts throughout the several views.

Figure 2:
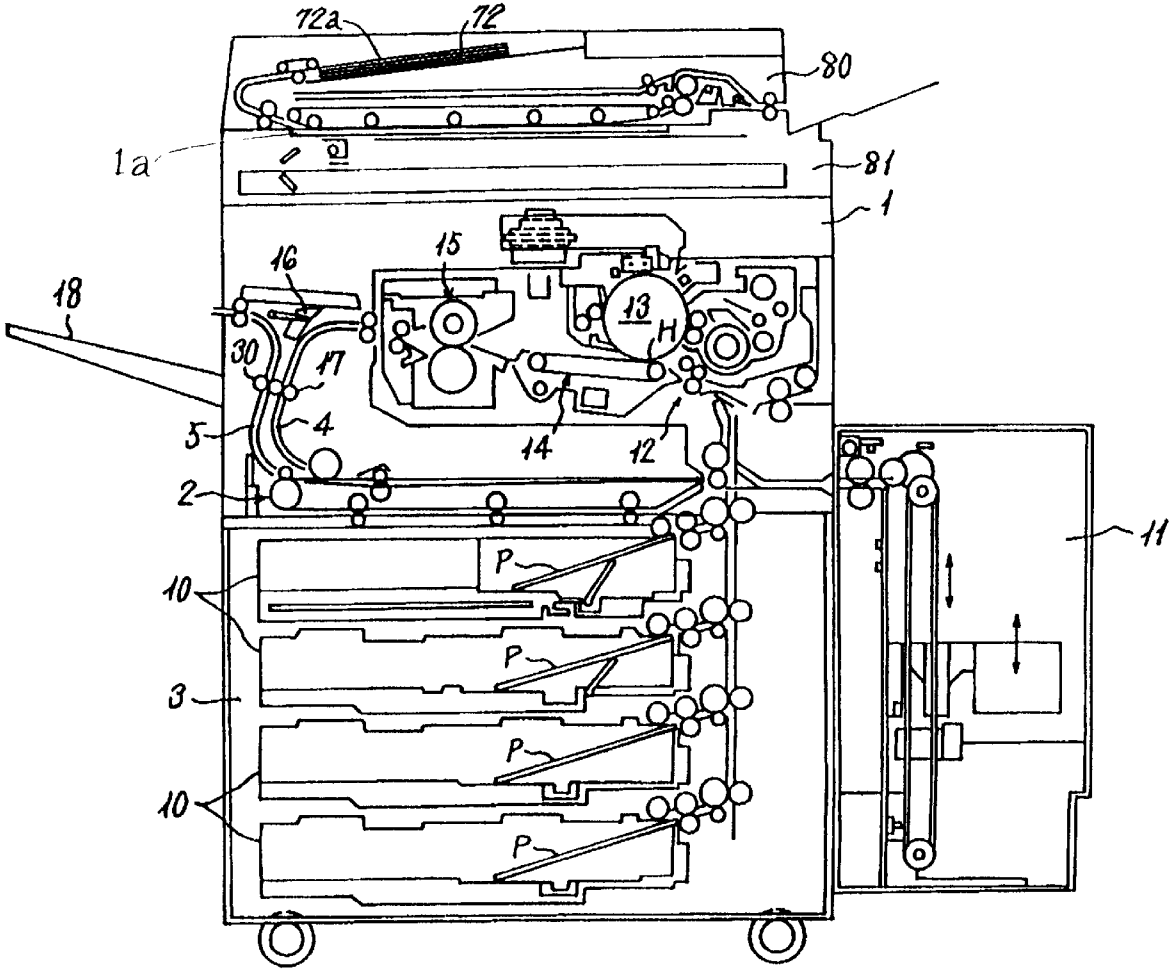
FIG. 2 is a schematic view showing a structure of an image forming apparatus according to one embodiment of the present invention.

FIG. 2 is a transverse sectional view showing a digital photocopier as an image forming apparatus according to the embodiment of the present invention. In the digital photocopier, sheets P as recording materials are stacked on a plurality of sheet feeding trays 10 inside a sheet feeding device 3 provided at a lower part of a main body of an image forming apparatus 1 or in a large capacity sheet feeding tray 11 provided on a side of the main body of the image forming apparatus 1. The sheets P can include plain paper, cardboard or thin paper, glossy paper, sheet-like resin films, name cards, post cards, and the like.

Disposed on the main body of the image forming apparatus 1 is an automatic document feeder (ADF) 80 in which stacked/laid documents 72 are taken in from its top part 72*a* and fed onto a contact glass 1*a* as a document laying section. An exposure scanning device 81 including a light source is disposed under the contact glass 1*a*. The automatic document feeder 80 is openably/closably disposed relative to the contact glass 1*a*. In the digital photocopier, the documents are stacked with surfaces to be scanned facing upward. This may be a high speed machine which can photocopy 50 or more sheets in a minute.

A sheet conveying path for conveying the sheets P in the digital photocopier is now described. The sheet P fed from a sheet feeding tray 10 or the large capacity sheet feeding tray 11 is conveyed to a drum-like photoconductive element 13 as an image bearing member via a registration roller pair 12 provided upstream of the photoconductive element 13 in the sheet conveying direction at a predetermined timing. A toner image is transferred to the sheet P in a transfer section H formed between the photoconductive element 13 and a belt transfer device 14 disposed opposite the photoconductive element 13. The sheet P with the image transferred thereto is then conveyed to a fixing device 15 disposed downstream of the belt transfer device 14 in the sheet conveying direction and provided with heating and pressing rollers, so that the transferred toner image is fixed on the sheet P.

The sheet P with the image fixed thereto is then conveyed to a reversing unit 2 or a sheet discharging tray 18 via a selecting part disposed further downstream of the fixing device 15 in the sheet conveying direction and provided with a reverse selecting pick 16, which is switched by an electromagnetic actuator (not shown) as a drive device in accordance with a photocopying mode selected beforehand by an operator. The electromagnetic actuator for use is large enough to provide a required or more suction power. Therefore, even when the suction power is lowered after continuous operation of the electromagnetic actuator, a required suction power can be continuously obtained.

With reference to FIG. 1, the reverse selecting pick 16 is usually in a second position indicated by a solid line. When a single-sided copy mode is selected, the reverse selecting pick 16 is moved to a first position indicated by a two-dots-and-dash line in FIG. 1, and the sheet P is guided to sheet discharging rollers 32, 37. When a duplicating mode or a reverse discharging mode is selected, the sheet P is guided along the reverse selecting pick 16 to a reverse path 4 as a first conveying path connecting the fixing device 15 and the reversing unit 2, and is conveyed to the reversing unit 2 in a direction indicated by an arrow A.

Disposed before the reverse selecting pick 16 are a curl removing device formed of a plurality of feeding rollers 18*a*, 18*b*, 18*c* and an upper guide plate 19 provided openably/closably via a shaft 19*a* on the main body of the image forming apparatus 1. The curl removing device makes a curled sheet P straight, and the upper guide plate 19 enables an operator to access a jammed sheet P easily.

A mechanical sheet sensor 70 as a recording material detecting device is disposed between the reverse selecting pick 16 and the plurality of feeding rollers 18*a*, 18*b*, 18*c*. A tip end of the sheet P is detected by the sheet sensor 70, which is electrically connected to a control device (not shown). In the control device, it is configured that when a detection signal is transmitted from the sheet sensor 70, the reverse selecting pick 16 is controlled to switch before a rear end of the sheet P passes the reverse selecting pick 16. Therefore, when sheets are continuously fed, a conveying interval between a previous sheet P and a following sheet P can be reduced.

Figure 3:
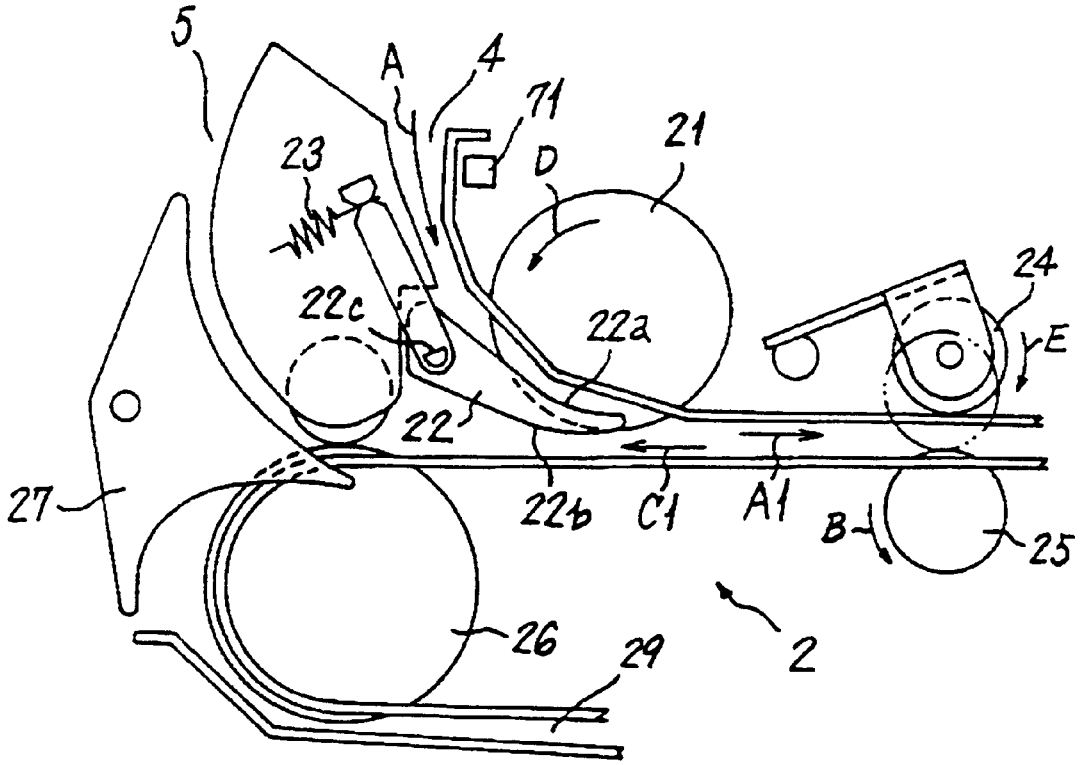
FIG. 3 is an enlarged view showing a structure of a reversing section of the image forming apparatus shown in FIG. 2.
Figure 4:
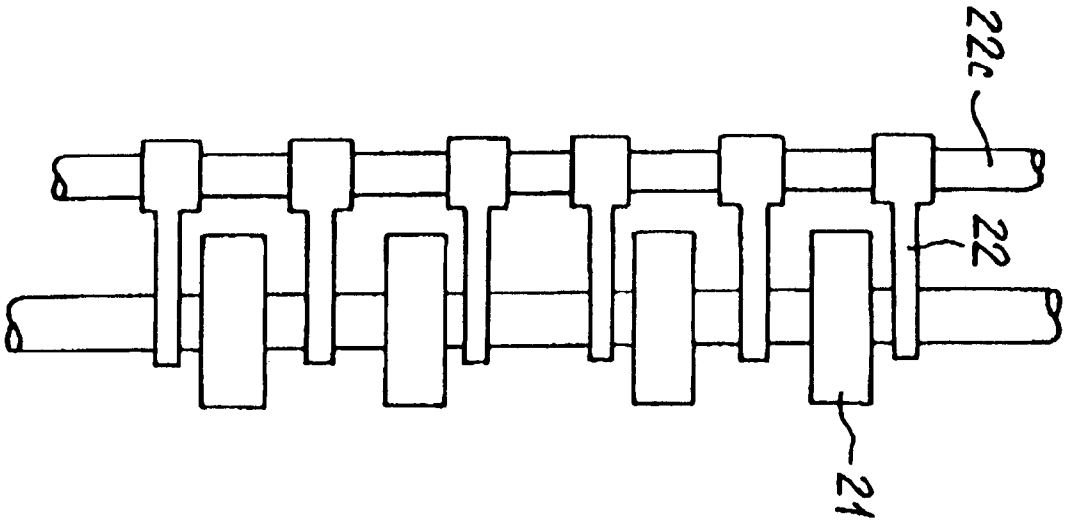
FIG. 4 is a schematic view of selecting picks and transfer rollers as viewed from an underneath position.

In the reversing unit 2, as shown in FIGS. 1, 3 and 4, a selecting pick 22 is swingably supported via a shaft 22*c* in the vicinity of reversing rollers 21 rotated/operated in a feeding direction indicated by an arrow D such that a tip end of each selecting pick 22 is positioned between adjacent reversing rollers 21. The selecting pick 22 is biased by a coil spring 23 as an elastic member so that a curving face part 22*a* that faces the reversing rollers 21 encroaches between the reversing rollers 21; the closer to the tip end of the selecting pick 22, the deeper the curving face part 22*a* encroaches. The biasing force of the coil spring 23 is set smaller than an advancing force of the sheet P. Thereby, when the sheet P is conveyed along the arrow direction A to a point between the reversing roller 21 and the selecting pick 22, the selecting pick 22 is rotated against an action of the coil spring 23 by an advancing force of the sheet P.

An optical sensor 71 as a sheet detecting device is disposed in the vicinity of the reversing rollers 21. The rear end of the sheet P is detected by the optical sensor 71, which is electrically connected to a control device (not shown). In the control device, it is configured that when a detection signal is transmitted to the control device from the optical sensor 71, and a predetermined time elapses after the rear end of the sheet P is detected, a switchback driven roller 24 (FIG. 3) provided in the reversing unit 2 is controlled to press against a switchback drive roller 25 facing the switchback driven roller 24 in a direction indicated by an arrow E. The above-described configuration enhances detection accuracy as compared with a structure in which a mechanical sensor is used, and stabilizes timing at which the switchback driven roller 24 contacts or separates from the switchback drive roller 25.

When the rear end of the sheet P passes the selecting picks 22 by being conveyed by an advancing force of the selecting picks 22 and the reversing rollers 21, the switchback driven roller 24 rotates in a direction indicated by an arrow E, and the sheet P is nipped between the switchback driven roller 24 and the switchback drive roller 25 which is continuously rotated in the direction indicated by an arrow B. The sheet P is inhibited from moving in an advancing direction indicated by an arrow A1 in FIG. 3, and is conveyed in a feeding direction indicated by an arrow C1 (hereinafter referred to as a feeding direction C1), in which the rear end of the sheet P turns to be a front end. In this construction, when the sheets P are continuously fed, the sheets P pass each other in the reversing unit 2, so that between-sheet timing is reduced. Additionally, since the timing at which the switchback driven roller 24 contacts or separates from the switchback drive roller 25 is stabilized, the sheet P can be fed from the reversing unit 2 with accurate timing. Accordingly, high speed operation of the apparatus and reduction of paper jams can be achieved.

When the sheet P is conveyed in the feeding direction C1, each selecting pick 22 is returned to the encroaching position of FIG. 3 and the sheet P is guided by a back side 22*b* of the selecting pick 22. Subsequently, the sheet P is guided to either a reversed sheet discharging path 5 of a second conveying path connecting the reversing unit 2 and the sheet discharging tray 18 or a duplication re-feeding path 29 via a duplication roller 26 according to a switching direction of a duplication selecting pick 27. Therefore, when reverse discharging for page arrangement is selected, the sheet P is guided to the reversed sheet discharging path 5 by the duplication selecting pick 27, and is discharged to an outside of the main body of the image forming apparatus 1 via the discharging rollers 32 and 37. When a duplication copying mode is selected, the sheet P is re-fed to the transfer section H through the duplication re-feeding path 29 by the duplication selecting pick 27. Additionally, the sheet P fed from the reversing unit 2 is conveyed with its front and rear ends slightly curled upward in this embodiment.

Figure 6:
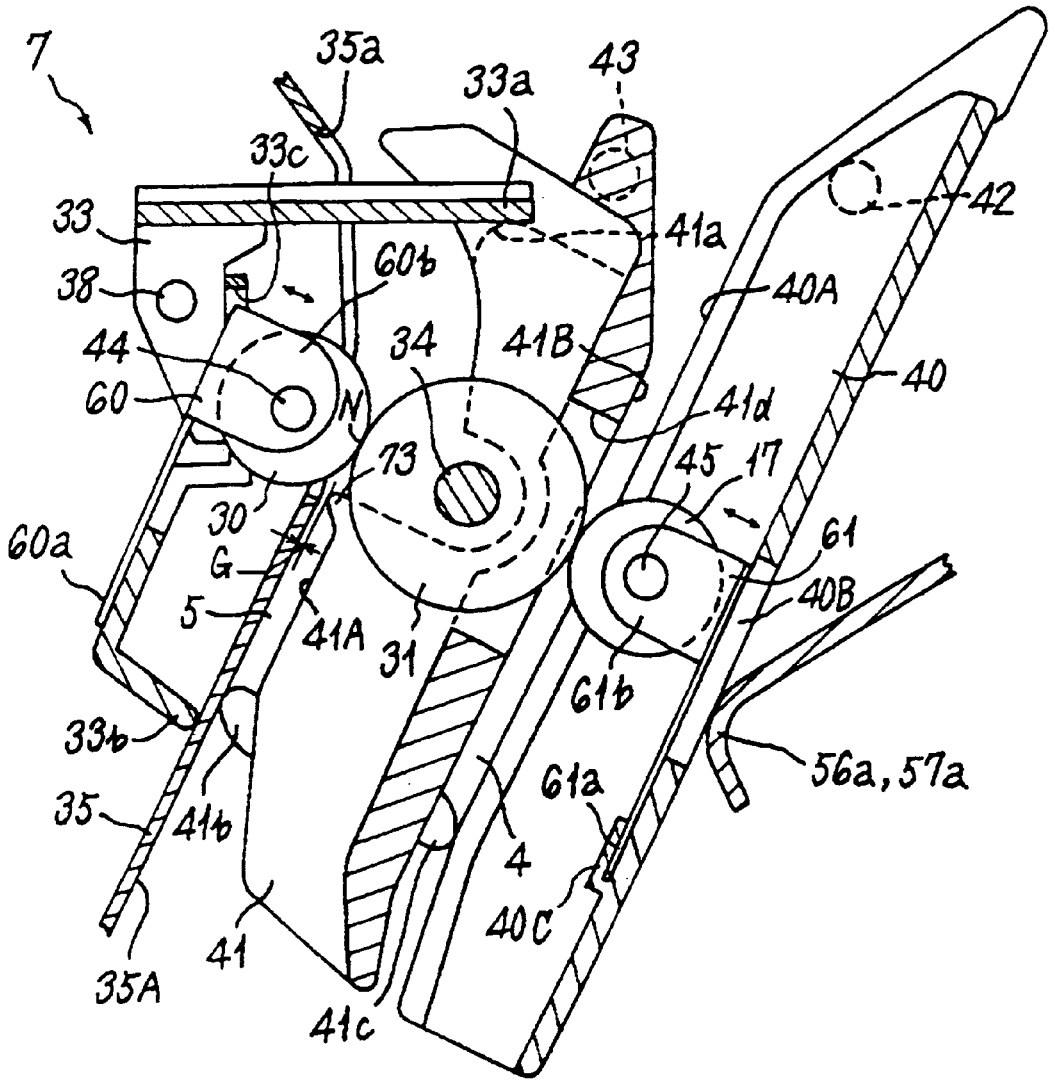
FIG. 6 is an enlarged sectional view showing a structure of a displacement device.
Figure 9:
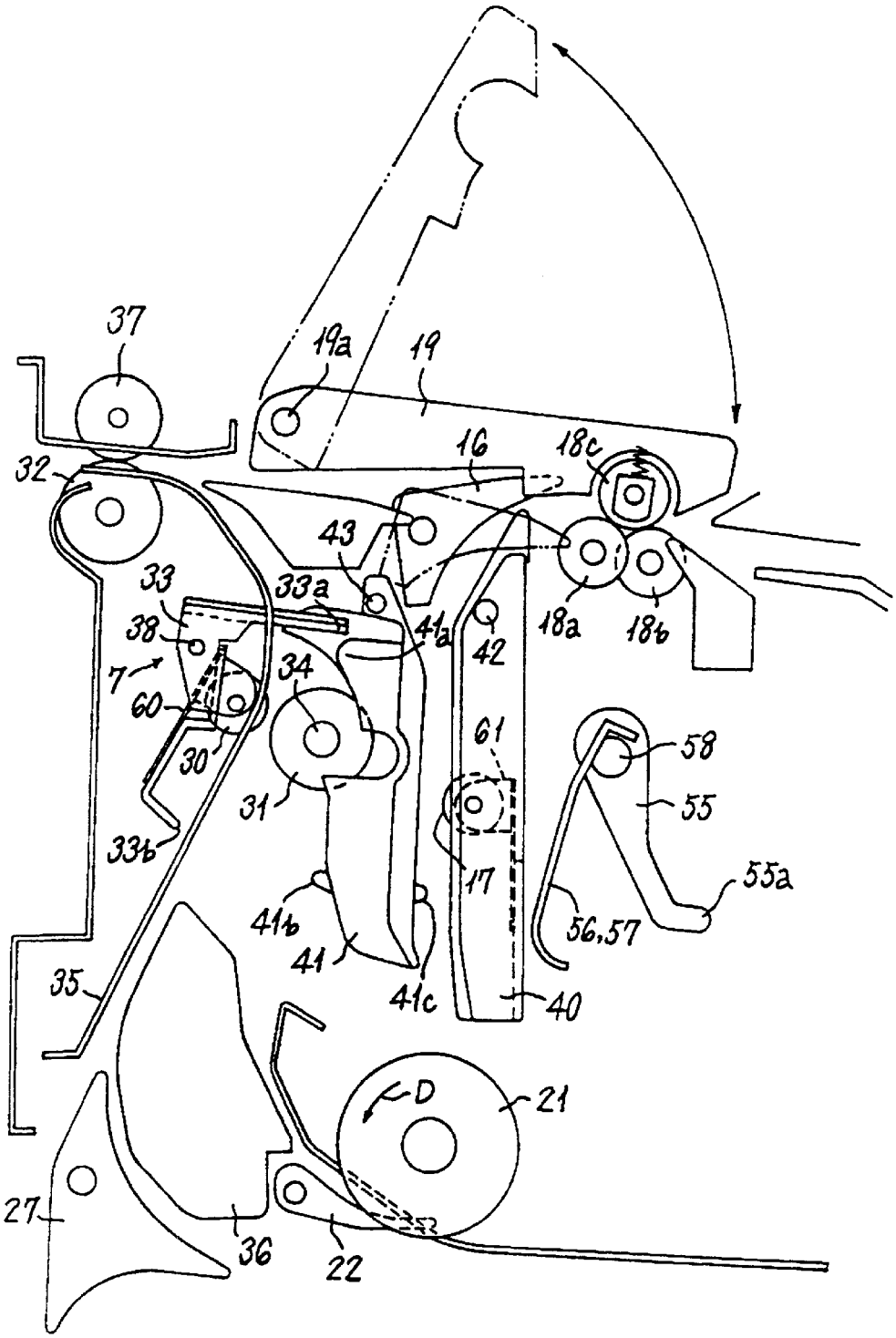
FIG. 9 is an enlarged view showing an open state of the first and second conveying paths by the displacement device.

As shown in FIG. 1, a part of the reverse path 4 and the reversed sheet discharging path 5 are arranged in parallel with each other. The reverse path 4 is substantially formed by a right swingable guide plate 40 as a guide member swingably mounted on a shaft 42 at its upper side, and a left swingable guide plate 41 as a guide member swingably mounted on a shaft 43 at its upper side. The reversed sheet discharging path 5 is substantially formed by the left swingable guide plate 41 and a sheet discharging guide plate 35 as a fixed member provided opposite the left swingable guide plate 41 on the main body of the image forming apparatus 1. The right swingable guide plate 40 and the left swingable guide plate 41 are provided to be movable between a sheet guide position in which the guide plates 40 and 41 are shut and inclined for guiding the sheet P as shown in FIG. 6 and a sheet jam removing position in which the guide plates 40 and 41 are vertical relative to the shafts 42 and 43 for opening the reverse path 4 and the reversed sheet discharging path 5 as shown in FIG. 9. Disposed in the vicinity of the right swingable guide plate 40 is a displacement device 6 for holding the right and left swingable guide plates 40 and 41 in the sheet guide position in which they are inclined (see FIGS. 1 and 6) in a direction rotated clockwise from the sheet jam removing position (see FIG. 9).

Figure 8:
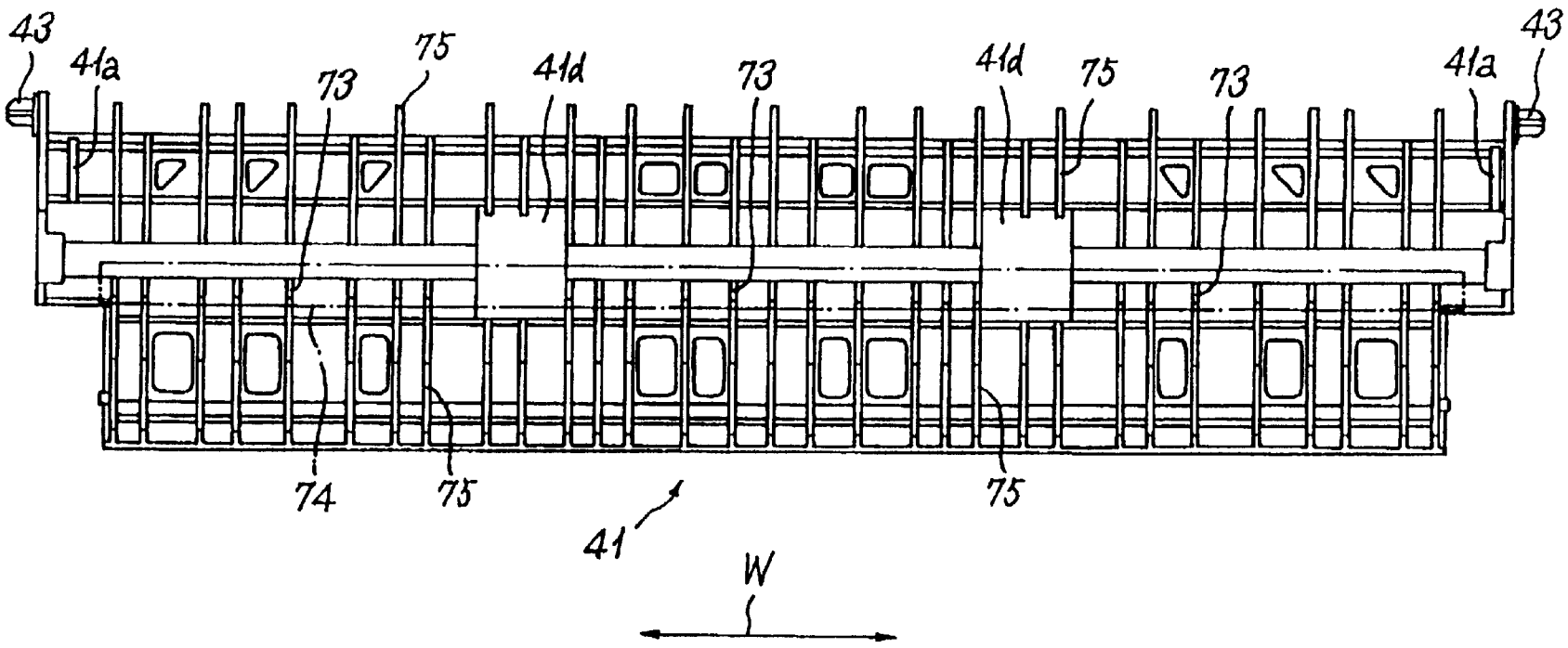
FIG. 8 is a plan view showing a structure of a guide member constituting a part of a second conveying path.

A drive roller 31 is disposed facing the reverse path 4 and the reversed sheet discharging path 5 in an area between the paths 4 and 5. Two drive rollers 31 are provided on a drive shaft 34 rotated/operated by a drive device (not shown) along a sheet width direction. As shown in FIG. 8, openings 41*d* and ribs 75 are provided in the left swingable guide plate 41 in a sheet width direction W. As shown in FIG. 6, when the left swingable guide plate 41 is in the sheet guide position, the drive roller 31 is fixed such that its outer peripheral face is protruded from conveying faces 41A and 41B of the left swingable guide plate 41 via the openings 41*d*.

As shown in FIG. 1, a driven roller 17 and a driven roller 30 are disposed opposite the drive roller 31 so as to press the drive roller 31 in the reverse path 4 and the reversed sheet discharging path 5. The drive roller 31 and the driven roller 17 constitute a pair of conveying rollers across the reverse path 4, while the drive roller 31 and the driven roller 30 constitute a pair of conveying rollers across the reversed sheet discharging path 5. As shown in FIG. 6, the conveying faces 41A and 41B of the left swingable guide plate 41 are provided with pressing protrusions 41*b* and 41*c*, respectively. When the left swingable guide plate 41 and the right swingable guide plate 40 are in the sheet guide position, the pressing protrusion 41*b* abuts on a conveying face 35A of the sheet discharging guide plate 35, and the pressing protrusion 41*c* abuts on a conveying face 40A of the right swingable guide plate 40.

As shown in FIG. 1, the reversed sheet discharging path 5 is provided with conveying direction switching sections 5A and 5B respectively upstream and downstream of the drive roller 31 in the conveying direction of the sheet P. The conveying direction switching section 5A is curved/formed in the same direction as a curled direction of the sheet P fed from the reversing unit 2, while the conveying direction switching section 5B is curved/formed in a direction reverse to the curled direction of the sheet P, so that the entire path of the reversed sheet discharging path 5 is formed in an inverted S shape when the left swingable guide plate 41 is in the sheet guide position. In this construction, curvatures of the conveying direction switching sections 5A and 5B can be formed larger as compared with the case that the reversed sheet discharging path 5 is formed vertically. Owing to these curvatures, the sheet curl made during sheet conveying is corrected and an occurrence of sheet jam is reduced.

As shown in FIG. 6, a guide protrusion 73 is protruded toward the sheet discharging guide plate 35 from the conveying face 41A of the guide plate 41 positioned upstream of a nipping portion N of the drive roller 31 and the driven roller 30 in the conveying direction. As shown in FIG. 8, a plurality of guide protrusions 73 are provided in an area 74 in the sheet width direction W. Therefore, as shown in FIG. 6, a gap G just before the nipping portion N in the reversed sheet discharging path 5 is reduced to prevent the sheet P conveyed from the reversing unit 2 from fluttering in the reversed sheet discharging path 5.

As described above, in this embodiment, since the reverse path 4 for conveying the sheet P from the fixing device 15 to the reversing unit 2 and the reversed sheet discharging path 5 for conveying the sheet P to an outside of the main body of the image forming apparatus 1 from the reversing unit 2 are separately provided, the sheet intervals of the continuously fed sheets P can be narrowed. Therefore, high speed operation of the image forming apparatus can be achieved, while an occurrence of a sheet jam during conveying can be reduced.

Figure 7:
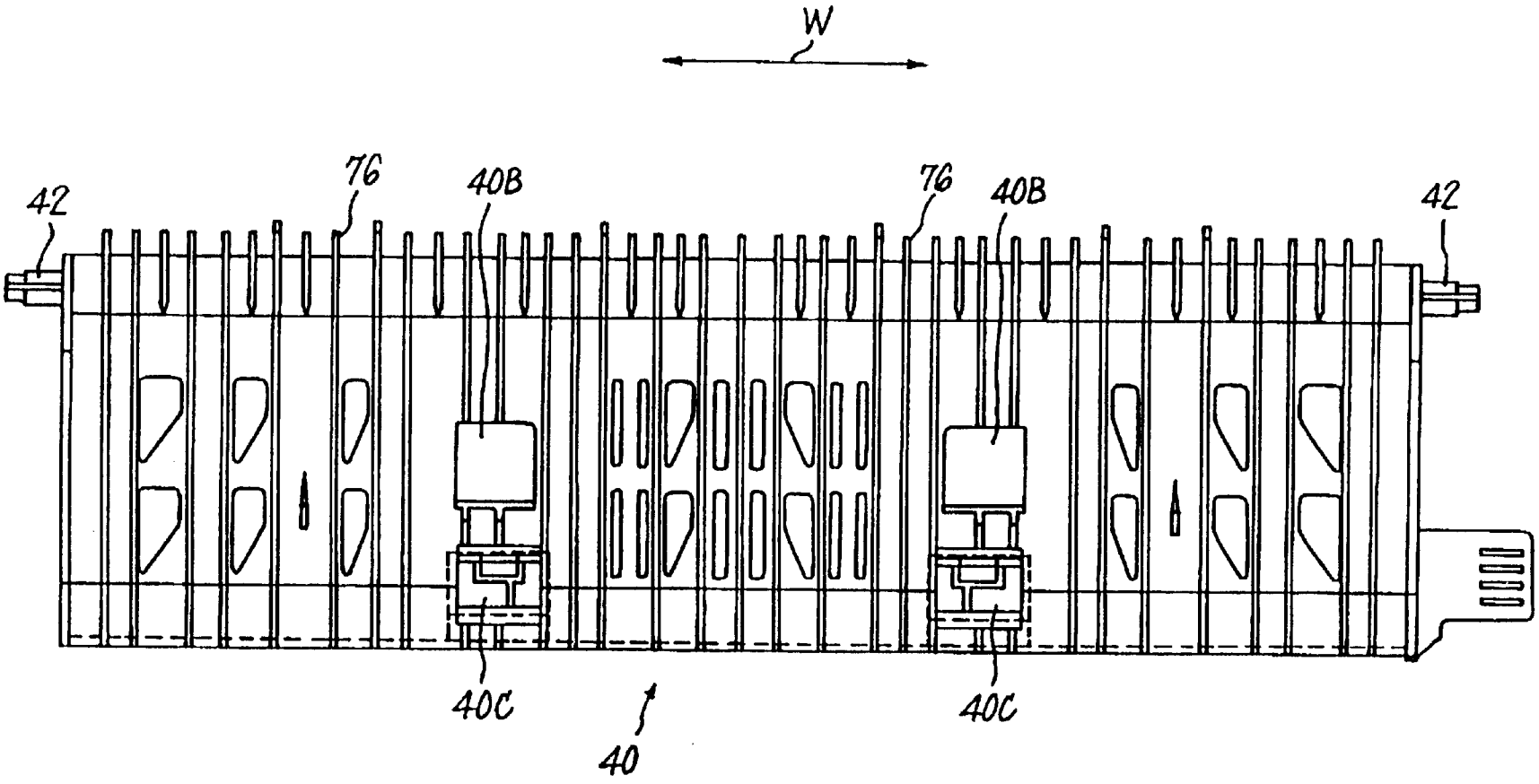
FIG. 7 is a plan view showing a structure of a guide member constituting a part of a first conveying path.

As shown in FIG. 7, the right swingable guide plate 40 is provided in the sheet width direction W with openings 40B, attachment portions 40C, and ribs 76. As shown in FIG. 6, the driven roller 17 is rotatably supported by a shaft 45 with one end 61*b* of an elastic support member 61 formed of a leaf spring, a resin plate, or the like. In this embodiment, two elastic support members 61 are provided, whose base ends 61*a* are attached to a pair of attachment portions 40C shown in FIG. 7, respectively. The outer peripheral face of the driven roller 17 partially protrudes from the conveying face 40A via the opening 40B to face an inside of the reverse path 4. When the right swingable guide plate 40 is in the sheet guide position, the driven roller 17 is configured to press against the drive roller 31 with a predetermined pressure.

Further, as shown in FIG. 6, the driven roller 30 is attached to a bracket 33 as a support member disposed in the vicinity of the sheet discharging guide plate 35 via an elastic member 60 of a leaf spring, a resin plate, or the like. The driven roller 30 is rotatably supported by a shaft 44 via the elastic member 60.

Figure 5:
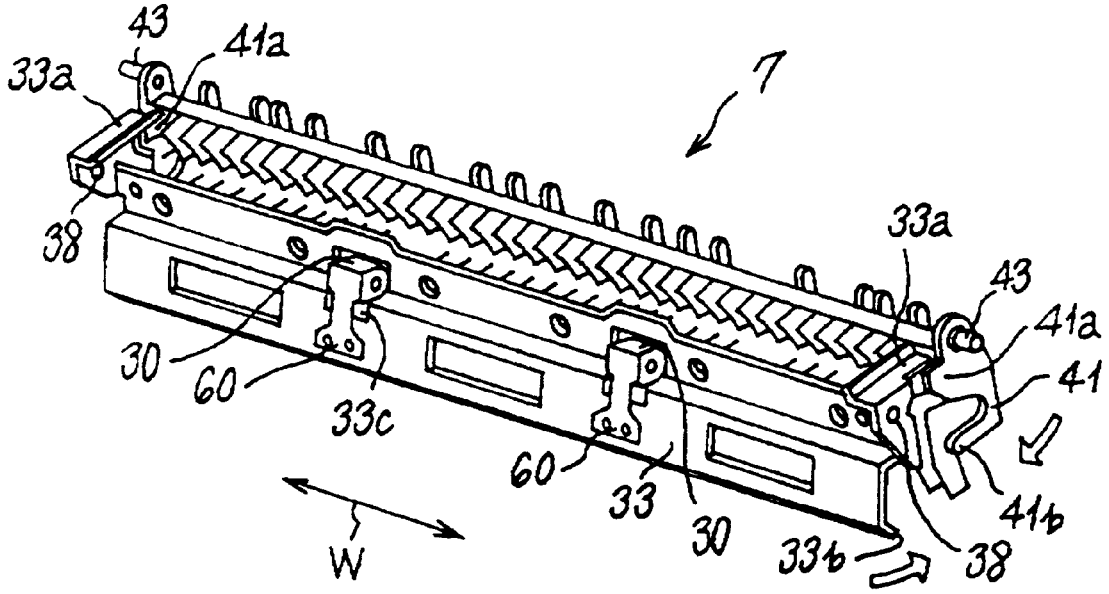
FIG. 5 is a schematic perspective view showing a relationship among a swing member, a support member, and driven rollers.

As shown in FIGS. 5 and 6, the bracket 33 is attached to a side plate (not shown) of the main body of the image forming apparatus 1 such that it can swing around support portions 38, and openings 33*c* are formed in the upper portion of the bracket 33. One end 60*a* of the elastic member 60 is attached/fixed to the bracket 33 below the opening 33*c*. The driven roller 30 rotatably supported by the other end 60*b* of the elastic member 60 faces the reversed sheet discharging path 5 via the opening 33*c* and an opening 35*a* formed in the sheet discharging guide plate 35.

One end, i.e. the upper end 33*a*, of the bracket 33 is formed in a flat plane, protruded into swinging range of the left swingable guide plate 41 via the opening 35*a*, and is disposed above an abutment portion 41*a* formed on the left swingable guide plate 41. When the left swingable guide plate 41 is in the sheet guide position shown in FIG. 6, the bracket 33 is elastically pressed onto the abutment portion 41*a* of the left swingable guide plate 41, is pushed up, and is swung around the support portion 38 in a counterclockwise direction to displace the driven roller 30 in a direction in which the drive roller 31 is pressed. When the left swingable guide plate 41 is set in the sheet jam removing position, the bracket 33 is disengaged from the abutment portion 41*a* to swing around the support portion 38 by gravity in a clockwise direction; i.e., the direction in which the driven roller 30 separates from the drive roller 31. The other end, i.e. the lower end 33*b*, of the bracket 33 is bent toward the sheet discharging guide plate 35, and is formed to abut on the sheet discharging guide plate 35 only when the left swingable guide plate 41 is in the sheet guide position. The driven roller 30 is supported by a support mechanism 7 provided with the bracket 33 and the elastic member 60 such that the driven roller 30 can be in or out of contact with the drive roller 31. When the left swingable guide plate 41 is in the sheet guide position, the driven roller 30 is configured to press onto the drive roller 31 with a predetermined pressure.

Figure 11:
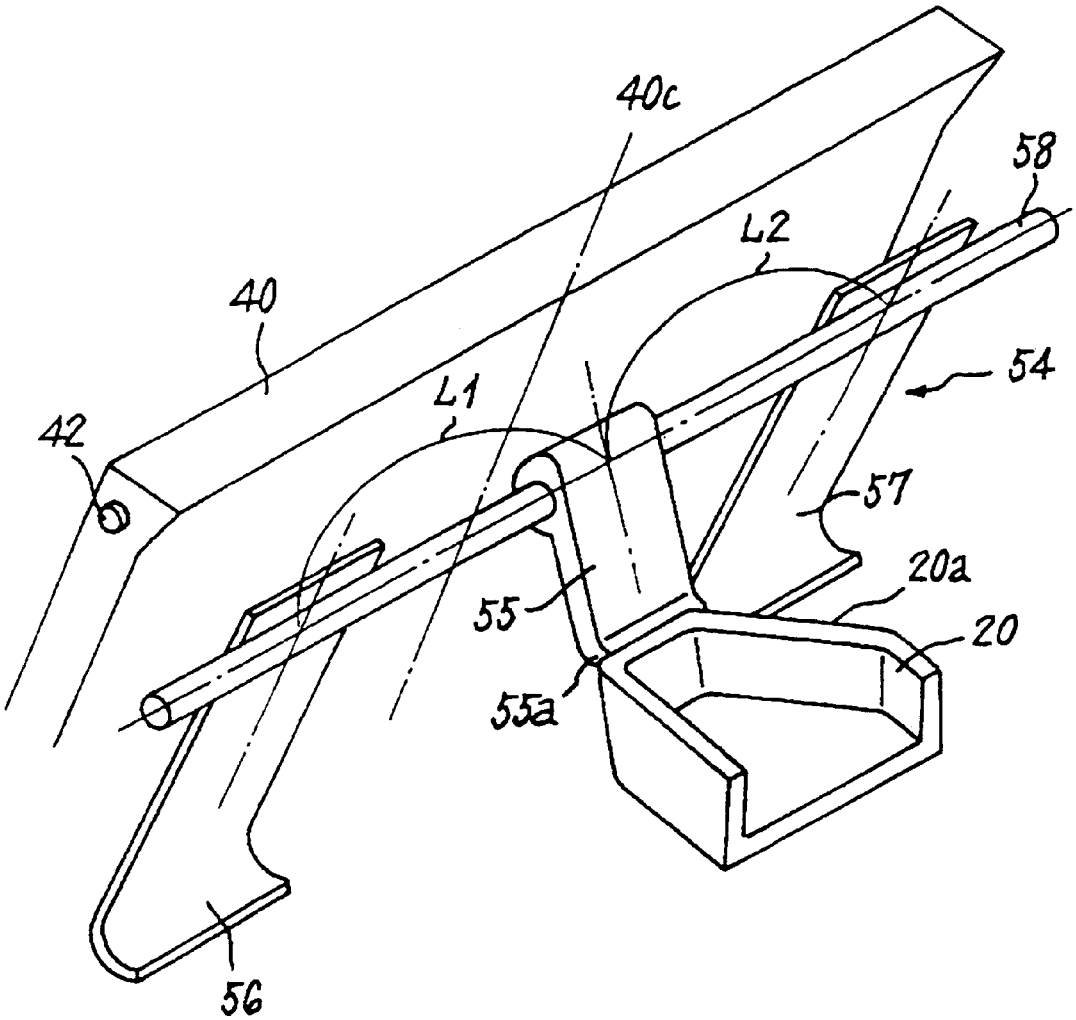
FIG. 11 is a perspective view showing a structure of an opening/shutting mechanism for the guide member.

Next, as shown in FIGS. 1 and 11, the displacement device 6 is provided with an opening/shutting mechanism 54. The opening/shutting mechanism 54 is composed of a swingable lever 55 as a swingable member provided on a rotation shaft 58, and pressing arms 56 and 57 as pressing members fixed to the rotation shaft 58 to abut on the right swingable guide plate 40. The reversing unit 2 is provided with a pressing cam 20 as a pressing device which can press the swingable lever 55. When the reversing unit 2 is set at a fully installed position within the main body, the swingable lever 55 is set in a position where its bent tip end 55*a* is pressed by a cam surface 20*a* of the pressing cam 20. The swingable lever 55 is pushed by the pressing cam 20 to rotate the rotation shaft 58 in the clockwise direction. Each of the pressing arms 56 and 57 is formed of, e.g., a leaf spring or another elastic member. When the reversing unit 2 is set at the fully installed position, as shown in FIG. 6, tip ends 56*a* and 57*a* of the pressing arms 56 and 57 abut on the right swingable guide plate 40 to press the right swingable guide plate 40 toward the sheet guide position. The right and left swingable guide plates 40 and 41 are constructed to be held in the sheet guide position by the operations of the pressing arms 56 and 57. The pressing cam 20 is disposed such that its cam surface 20*a* can press the swingable lever 55. When the reversing unit 2 is pushed into the main body of the image forming apparatus 1, the pressing cam 20 presses the right swingable guide plate 40 via the pressing arms 56 and 57 and holds the right swingable guide plate 40 in the sheet guide position. When the reversing unit 2 is pulled out, the pressure to the right swingable guide plate 40 is released.

Figure 10:
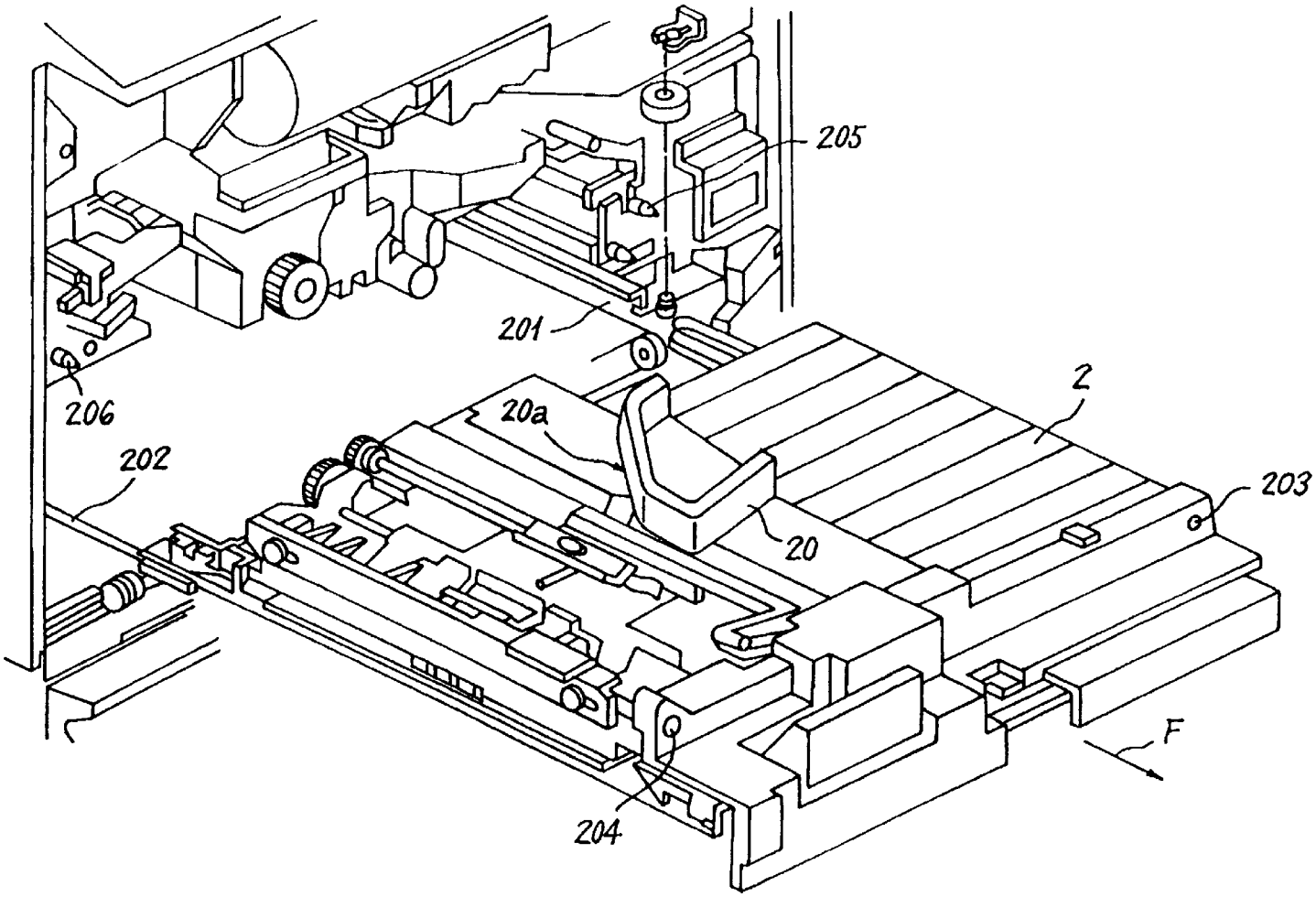
FIG. 10 is a schematic perspective view of the image forming apparatus when a reversing unit is pulled out.

As shown in FIG. 10, the reversing unit 2 is mounted on rightward and leftward guide rails 201 and 202 provided on the main body of the image forming apparatus 1 to be able to slide. When the reversing unit 2 is fully installed within the main body of the image forming apparatus 1, positioning pins 205 and 206 on the main body of the apparatus fit into positioning holes 203 and 204 formed in the reversing unit 2. Thereby, an accurate positioning of the reversing unit 2 can be assured. The pressing cam 20 is fixed at an approximately central part in a transverse direction at an upper side of the reversing unit 2.

In the digital photocopier constructed as described above, when a sheet jam occurs in the reverse path 4 or the reversed sheet discharging path 5, a sheet jam detecting device (not shown) detects the sheet jam and a controller (not shown) stops an operation of the apparatus. Then, the controller reports the sheet jam to an operator by a display, sound, or the like. Subsequently, the operator removes the jammed sheet, first by opening an outer cover (not shown) at a front side, and then by pulling out the reversing unit 2 toward the front side of the apparatus in a direction indicated by an arrow F in FIG. 10.

When the reversing unit 2 is pulled out in the direction indicated by the arrow F, the opening/shutting mechanism 54 becomes free to move since the cam surface 20*a* of the pressing cam 20 moves out from the swingable lever 55. Then, the pressure to the right and left swingable guide plates 40 and 41 by the pressing arms 56 and 57 is released. Thereby, the right and left swingable guide plates 40 and 41 are rotated around the shafts 42 and 43 by gravity in the counterclockwise direction from the sheet guide position shown in FIG. 6 to move to the sheet jam removing position shown in FIG. 9 in which the right and left swingable guide plates 40 and 41 hang down vertically. At this time, the driven roller 17 that is supported by the right swingable guide plate 40 is separated from the drive roller 31 due to the movement of the right swingable guide plate 40 towards the sheet jam removing position. When the left swingable guide plate 41 moves to the sheet jam removing position, the pressing portion 41*a* of the left swingable guide plate 41 is separated from the upper end 33*a* of the bracket, which has been pushed up from below by the pressing portion 41*a*. Then, the bracket 33 is rotated around the support portion 38 by gravity in the clockwise direction, and the driven roller 30 supported by the bracket 33 is separated from the drive roller 31.

On the other hand, when the reversing unit 2 is pushed into the main body of the image forming apparatus 1, the cam surface 20*a* abuts on the swingable lever 55, and the pressing arms 56 and 57 are rotated around the rotation shaft 58 in the clockwise direction. Thereby, the right swingable guide plate 40 is pressed by the pressing arms 56 and 57 and is rotated up toward the sheet guide position around the shaft 42, and the driven roller 17 is also moved together with the right swingable guide plate 40. While the right swingable guide plate 40 is moved, the driven roller 17 abuts on the drive roller 31 and presses the roller 31 by deformation of the elastic support member 61. The guide face 40A abuts on the pressing protrusion 41*c* to push up the left swingable guide plate 41. Further, when the left swingable guide plate 41 is rotated toward the sheet guide position around the shaft 43, the pressing portion 41*a* is engaged with the upper end 33*a* from below to push up the bracket 33. Then, the bracket 33 is rotated around the support portion 38 in the counterclockwise direction until the lower end 33*b* abuts on the sheet discharging guide plate 35. The driven roller 30 supported by the bracket 33 is moved toward the drive roller 31, and is pressed onto the drive roller 31 by deformation of the elastic member 60.

When the reversing unit 2 is pushed into the main body of the image forming apparatus 1, the right and left swingable guide plates 40 and 41 are moved together until the reversing unit 2 is completely installed within the main body of the apparatus. Then, the right and left swingable guide plates 40 and 41 are stopped and held in the sheet guide position.

In the displacement device 6 configured to operate as described above, when the reversing unit 2 is pulled out in the direction of the arrow F, the right and left swingable guide plates 40 and 41 move to the sheet jam removing position from the sheet guide position, so that the reverse path 4 and the reversed sheet discharging path 5 are opened. Thereby, the jammed sheets P can easily be removed from the reverse path 4 and the reversed sheet discharging path 5. Moreover, when the reversing unit 2 is completely pushed in the main body of the image forming apparatus 1, the right and left swingable guide plates 40 and 41 are held in the sheet guide position. Thereby, the positions of the right and left swingable guide plates 40 and 41 relative to the sheet P are accurately set, and the pressures applied to the guide plates 40 and 41 are stabilized. Therefore, the sheet P can be prevented from being jammed, and the swingable guide plates 40 and 41 can be prevented from being broken or deformed.

If the jammed sheet P extends beyond the reverse path 4 into the reversing unit 2, or beyond the reversed sheet discharging path 5 into the reversing unit 2, the reversing unit 2 needs to be pulled out in the direction of the arrow F to open the reverse path 4 or the reversed sheet discharging path 5. In this situation, the jammed sheet P may be torn off when one end of the jammed sheet P is pulled by the movement of the reversing unit 2 before another end of the jammed sheet P is released from the reverse path 4 or the reversed sheet discharging path 5. However, in this embodiment, since the right swingable guide plate 40 is provided with the driven roller 17, the driven roller 17 is moved together when the right swingable guide plate 40 is moved/displaced toward the sheet jam removing position. Therefore, if the sheet P is jammed in the reverse path 4, the sheet P is prevented from being held between the pair of feeding rollers of the reverse path 4, and the jammed sheet P can be securely removed without being torn. Moreover, the bracket 33 supporting the driven roller 30 via the elastic member 60 is provided such that the bracket 33 is rotated by gravity in a direction in which the driven roller 30 is separated from the drive roller 31 when the left swingable guide plate 41 is in the sheet jam removing position. With the operation for opening the reversed sheet discharging path 5, the driven roller 30 is securely separated from the drive roller 31 without any separating operation by a particular member. Accordingly, even if the sheet P is jammed in the reversed sheet discharging path 5, the jammed sheet P can be securely removed without being torn.

Further, as described above, when the left swingable guide plate 41 is in the sheet guide position, the bracket 33 abuts on the abutment portion 41*a* to move the driven roller 30 in a direction in which the driven roller 30 abuts on the drive roller 31. Then, the lower end 33*b* of the bracket 33 abuts on the sheet discharging guide plate 35, so that there is no gap between the lower end 33*b* and the sheet discharge guide plate 35. Owing to this construction, the position of the driven roller 30 is accurately set and the pressing force between the drive roller 31 and the driven roller 30 is stabilized without producing excessive pressure, when the left swingable guide plate 41 is in the sheet guide position. Accordingly, the sheets P are effectively conveyed in the paths, and a sheet jam is prevented while high speed operations of the apparatus can be achieved.

Furthermore, the feeding faces 41A and 41B of the left swingable guide plate 41 disposed between the sheet discharging guide plate 35 and the right swingable guide plate 40 are provided with the pressing protrusions 41*b* and 41*c*. When the right and left swingable guide plates 40 and 41 are in the sheet guide position, the protrusion 41*b* abuts on the conveying face 35A of the sheet discharging guide plate 35, and the protrusion 41*c* abuts on the conveying face 40A of the right swingable guide plate 40. Thus, the sheet guide positions of the right and left swingable guide plates 40 and 41 are set accurately. In the above-described construction, the gap of the reverse path 4 or the reversed sheet discharging path 5 is stably held. Further, the pressing force of the driven rollers 17 and 30 onto the drive roller 31 and the pressure applied to the right or left swingable guide plates 40 and 41 are prevented from excessively increasing. Accordingly, the sheets P are effectively conveyed in the paths 4 and 5, and the right and left swingable guide plates 40 and 41 can be prevented from being broken or deformed.

The right or left swingable guide plates 40 and 41 can be wide enough to guide a maximum size sheet P that is used in the apparatus. Accordingly, if the pressure for keeping the right and left swingable guide plates 40 and 41 in the sheet guide position is inclined to one side, the sheet P may be skewed. To solve this problem, in the present embodiment, as shown in FIG. 11, the swingable lever 55 is fixed on the rotation shaft 58 at a position approximately aligned with a sheet P conveying center 40*c*. Additionally, the pressing arms 56 and 57 have a same shape and are mounted at positions approximately equally spaced from the sheet P conveying center 40*c* (i.e. L1=L2 in FIG. 11). In this construction, a twist of the rotation shaft 58 can be avoided since the pressure of the pressing cam 20 is applied at the center of the rotation shaft 58 via the swingable lever 55. Furthermore, since the right swingable guide plate 40 is pressed by the pressing arms 56 and 57 symmetrically mounted about the sheet conveying center 40*c*, the pressure can be uniformly applied in the width direction of the sheet P, i.e., the width direction of the right swingable guide plate 40. Therefore, sheet P conveying skew due to unevenness of the pressure to the width direction of the right swingalbe guide plate 40 can be prevented.

The preferred embodiment of the present invention has been explained above. In the embodiment, the conveying faces 41A and 41B of the left swingable guide plate 41 are provided with the pressing protrusions 41*b* and 41*c*. However, the protrusions could instead be formed on the conveying face 35A of the sheet discharging guide plate 35 and the conveying face 40A of the right swingable guide plate 40, with a similar effect. Further, the present invention is described as applied to a digital photocopier, but may be applied to a printer, a facsimile machine in which a toner image is formed in accordance with image information transmitted by wire or by radio from a personal computer or a similar information terminal apparatus, or image information received via communication equipment, or applied to a multifunctional machine in which the functions of a photocopier, a printer, and a facsimile machine are combined.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application No. JPAP10-041733 filed in the Japanese Patent Office on Feb. 24, 1998, and on Japanese patent application No. JPAP10-199180 filed in the Japanese Patent Office on Jul. 14, 1998, and the entire contents of which are hereby incorporated by reference.

I claim:

1. An image forming apparatus, comprising:

a fixing device configured to fix a toner image on a recording material;

a reversing unit movably provided in a main body of the image forming apparatus and configured to reverse and feed the recording material fed from the fixing device carrying a toner image fixed thereto;

a guiding device configured to guide the recording material fed from the fixing device toward an outside of the main body of the image forming apparatus, the guiding device including first and second guide members facing each other to form a part of a first conveying path in which the recording material with a toner image fixed thereto is conveyed to the reversing unit from the fixing device, the second guide member forming, in cooperation with a third guide member which is fixed in the main body of the image forming apparatus, a part of a second conveying path in which the recording material fed from the reversing unit is conveyed to the outside of the main body of the image forming apparatus, the first and second conveying paths being arranged in parallel in the main body of the image forming apparatus, and being movable between a sheet guide position in which the first and second guide members guide the recording material along the first and second conveying paths and a sheet jam removing position in which each of the first and second conveying paths is opened for removal of a jammed sheet;

a feeding device configured to feed the recording material fed from the fixing device through the first and second conveying paths, respectively, the feeding device including a drive roller arranged facing both of the first and second conveying paths, a first driven roller arranged facing the first conveying path to contact the drive roller across the first conveying path, and a second driven roller arranged facing the second conveying path to contact the drive roller across the second conveying path; and a displacement device configured to displace the first and second guide members to the sheet guide position and the sheet jam removing position in cooperation with the reversing unit and to control the drive roller and the first and second driven rollers and to separate the drive roller from the first and second driven rollers in cooperation with the displacement of the first and second guide members.

2. An image forming apparatus according to claim 1, wherein the first and second guide members are inclined relative to a vertical direction in the sheet guide position.

3. An image forming apparatus according to claim 1, wherein the feeding device includes a plurality of drive rollers and driven rollers arranged in a width direction of the first and second conveying paths.

4. An image forming apparatus according to claim 1, wherein the second conveying path comprises conveying direction switching sections respectively curved in a curled direction and a reverse curled direction of the recording material fed from the fixing device upstream and downstream of the drive roller in a conveying direction of the recording material, respectively, and at least one guide protrusion for reducing a gap of the second conveying path at a portion of the second guide member located upstream of a nipping portion, formed by the drive roller and the driven roller, in the conveying direction of the recording material.

5. An image forming apparatus according to claim 1, further comprising a support member configured to support the second driven roller swingably provided to engage with the second guide member to displace the second driven roller in a direction to press against the drive roller when the second guide member is in the sheet guide position, and to disengage from the second guide member to be displaced by gravity in a direction in which the second driven roller is separated from the drive roller when the second guide member is in the sheet jam removing position, the second driven roller being mounted to the support member via an elastic member.

6. An image forming apparatus according to claim 5, wherein the support member is configured such that a first end of the support member positioned on an opposite side of a swing center of the support member relative to a second end of the support member engaging with the second guide member presses the third guide member disposed opposing the first end when the second guide member is in the sheet guide position.

7. The image forming apparatus according to claim 1, further comprising:

a swingable member mounted on a rotation shaft;

a pressing member fixed on the rotation shaft and configured to abut on and press against the first guide member; and a pressing device provided on the reversing unit and configured to press against the swingable member, the pressing device pressing the swingable member to hold the first and second guide members in the sheet guide position and releasing the pressed swingable member to hold the first and second guide members in the sheet jam removing position.

8. The image forming apparatus according to claim 1, further comprising:

an automatic document feeding device configured to take in documents from an uppermost document when the documents are stacked with surfaces to be read facing upward or from a lowermost document when the documents are stacked with surfaces to be read facing downward.

9. An image forming apparatus, comprising:

means for fixing a toner image on a recording material;

means for reversing and feeding the recording material fed from the fixing means carrying a toner image fixed thereto, the reversing means being movably provided in a main body of the image forming apparatus;

means for guiding the recording material fed from the fixing means toward an outside of the main body of the image forming apparatus, the guiding means including first and second guide members facing each other to form a part of a first conveying path in which the recording material with a toner image fixed thereto is conveyed to the reversing means from the fixing means, the second guide member forming, in cooperation with a third guide member which is fixed in the main body of the image forming apparatus, a part of a second conveying path in which the recording material fed from the reversing means is conveyed to the outside of the main body of the image forming apparatus, the first and second conveying paths being arranged in parallel in the main body of the image forming apparatus, and being movable between a sheet guide position in which the first and second guide members guide the recording material along the first and second conveying paths and a sheet jam removing position in which each of the first and second conveying paths is opened for removal of a jammed sheet;

means for feeding the recording material fed from the fixing means through the first and second conveying paths, respectively, the feeding means including a drive roller arranged facing both of the first and second conveying paths, a first driven roller arranged facing the first conveying path to contact the drive roller across the first conveying path, and a second driven roller arranged facing the second conveying path to contact the drive roller across the second conveying path; and means for displacing the first and second guide members to the sheet guide position and the sheet jam removing position in cooperation with the reversing means and for contacting the drive roller and the first and second driven rollers and separating the drive roller from the first and second driven rollers in cooperation with the displacement of the first and second guide members.

10. The image forming apparatus according to claim 9, wherein the first and second guide members are inclined relative to a vertical direction in the sheet guide position.

11. The image forming apparatus according to claim 9, wherein the feeding means includes a plurality of drive rollers and driven rollers arranged in a width direction of the first and second conveying paths.

12. The image forming apparatus according to claim 9, wherein the second conveying path comprises means for switching a conveying direction respectively curved in a curled direction and a reverse curled direction of the recording material fed from the fixing means upstream and downstream of the drive roller in a conveying direction of the recording material, respectively, and at least one guide means for reducing a gap of the second conveying path at a portion of the second guide member located upstream of a nipping portion, formed by the drive roller and the driven roller, in the conveying direction of the recording material.

13. The image forming apparatus according to claim 9, further comprising support means for supporting the second driven roller, the support means being swingably provided to engage with the second guide member to displace the second driven roller in a direction to press against the drive roller when the second guide member is in the sheet guide position, and to disengage from the second guide member to be displaced by gravity in a direction in which the second driven roller is separated from the drive roller when the second guide member is in the sheet jam removing position, the second driven roller being mounted to the support means via an elastic member.

14. The image forming apparatus according to claim 13, wherein the support means is configured such that a first end of the support means positioned on an opposite side of a swing center of the support means relative to a second end of the support means engaging with the second guide member presses the third guide member disposed opposing the first end when the second guide member is in the sheet guide position.

15. The image forming apparatus according to claim 9, further comprising:

swingable means mounted on a rotation shaft;

pressing means fixed on the rotation shaft to abut on and press against the first guide member; and means for pressing the swingable means, the pressing means being provided on the reversing means and pressing against the swingable means to hold the first and second guide members in the sheet guide position and releasing the pressed swingable means to hold the first and second guide members in the sheet jam removing position.

16. The image forming apparatus according to claim 9, further comprising:

automatic document feeding means for taking in documents from an uppermost document when the documents are stacked with surfaces to be read facing upward or from a lowermost document when the documents are stacked with surfaces to be read facing downward.

* * * * *